US005573056A

United States Patent [19]

Feichtinger et al.

[11] Patent Number: 5,573,056

[45] Date of Patent: Nov. 12, 1996

[54] PROCESS AND DEVICE FOR PRODUCING METAL STRIP AND LAMINATES

[75] Inventors: Heinrich K. Feichtinger; Derek H. Feichtinger, both of Hinteregg; Markus O. Speidel, Birmenstorf, all of Switzerland

[73] Assignee: Ilse H. Feichtinger, Hinteregg, Switzerland

[21] Appl. No.: 182,019

[22] PCT Filed: May 18, 1992

[86] PCT No.: PCT/CH92/00096

§ 371 Date: Feb. 28, 1994

§ 102(e) Date: Feb. 28, 1994

[87] PCT Pub. No.: WO93/23187

PCT Pub. Date: Nov. 25, 1993

[51] Int. Cl.[6] ..... B22D 11/06; B22D 23/00; B22D 27/04

[52] U.S. Cl. ..... 164/46; 164/423; 164/429; 164/444; 164/461; 164/463; 164/479; 164/486

[58] Field of Search ..... 164/461, 479, 164/486, 429, 444, 46, 463, 423

[56] References Cited

U.S. PATENT DOCUMENTS

| | | | |
|---|---|---|---|
| 2,148,802 | 2/1939 | Bunke . | |
| 4,523,626 | 6/1985 | Masumoto et al. | 164/479 X |
| 5,299,628 | 4/1994 | Ashok | 164/479 |

FOREIGN PATENT DOCUMENTS

| | | | |
|---|---|---|---|
| 0090973 | 10/1983 | European Pat. Off. . | |
| 832120 | 9/1938 | France . | |
| 56-77051 | 6/1981 | Japan | 164/479 |
| 59-47049 | 3/1984 | Japan | 164/479 |
| 61-135459 | 6/1986 | Japan | 164/444 |
| 61-135462 | 6/1986 | Japan | 164/461 |

OTHER PUBLICATIONS

Abstract of Japanese Patent Publication 2–263542 Published Oct. 26, 1990.

Abstract of Japanese Patent Publication 57–70062 Published Apr. 30, 1982.

Abstract of Japanese Patent Publication 61–212449 Published Sep. 20, 1986.

Abstract of Japanese Patent Publication 61–119355 Published Jun. 6, 1986.

Abstract of Japanese Patent Publication 57–156863 Published Sep. 28, 1982.

*Primary Examiner*—J. Reed Batten, Jr.

*Attorney, Agent, or Firm*—Cushman Darby & Cushman, L.L.P.

[57] ABSTRACT

A stream of overheated metal melt is applied from a container through a pouring nozzle as a closed jet, or in such a way as to be split up into drops by a gaseous medium, at a pouring point, to the inner surface of a strip coil or composite body also rotating in a mold body. Thus, an initially liquid metal film is produced to which a liquid coolant, preferably a low-temperature liquefied gas such as argon or nitrogen, is applied from a cooling nozzle at a cooling point which is offset in the direction of rotation relative to the pouring point. The coolant dissipates a substantial portion of the excess and melt heat of the metal film, mostly due to vaporization of the liquid coolant. Depending on the residual heat which it still has after the cooling operation, the metal film either remains isolated from the innermost metal layer applied beforehand, so that a strip coil develops, or melts with the metal layer so that a rotationally symmetrical composite body forms.

18 Claims, 8 Drawing Sheets

PROCESS AND DEVICE FOR PRODUCING METAL STRIP AND LAMINATES

BACKGROUND OF THE INVENTION

1. Field of the Invention

The invention relates to a process and device for the manufacture of strip and composite bodies of metal in which a stream or streams of overheated metal melt is/are directed towards a surface moving transversely to the stream direction, producing an initially liquid metal film.

2. Discussion of the Prior Art

Processes for the rapid solidification of metals have recently gained increasing importance, since they permit the manufacture of new types of materials having partly improved or even unusual structures and, consequently, material properties. With an increasing solidification rate, an ever increasing deviation from the equilibria as determined by the equilibrium diagram occurs as a result, since the extremely short diffusion times impede the appearance of these equilibria. This leads on the one hand to continually finer morphology, e.g. to the development of finer dendrites or eutectics while the interdendritic or cellular segregation is reduced and in some materials can lead to the development of highly metastable structures and even to the formation of metallic glasses in an exceptional case. During the crystalline solidification there is an advantage here in the fact that the solubility range of certain desired elements is greatly widened, whereas undesirable precipitations can be suppressed.

The fundamental principle of all processes for rapid solidification is rapid heat extraction. This action is determined on the one hand by the thermal conductivity of the metal and on the other hand by the mechanism of heat transfer at the phase boundary to the heat-extracting medium. Whereas the heat transfer, characterised by the heat transfer coefficient, can be optimised in a wide range by selecting the correct process conditions, the heat transport in the metal, which is characterised by the coefficient of thermal conductivity, can only be improved by the selection of shorter transport paths. Therefore all currently known methods of rapid solidification lead to castings which have only a small thickness at least in the spatial direction of the heat transport. Examples of this are splat cooling, where a metal drop is abruptly transformed into a foil between two metal plates, the melt-spinning process, where a metal stream is usually applied to the outer surface of a rapidly rotating roll, a thin metal film being formed in a continuous manner under the effect of the acceleration as well as by the heat extraction of the roll, which serves as a quenching body, and certain powder-atomising processes, where a metal stream is beaten into small drops under the effect of an atomising medium which can be a gas or even a liquid, which drops solidify in flight and can subsequently be fed to powder-metallurgical compacting processes. The theoretical principles of processes for rapid solidification are clearly described, for example, in a publication by R. Mehrabian, "Rapid Solidification", reproduced in "Rapid Solidification Technology Source Book", American Society for Metals 1983, pp. 186–209. The most common processes can be gathered from chapters by G. Haour, H. Bode, "From Melt to Wire", and R. E. Maringer, "Payoff Decade for Advanced Material", from the same book, pp. 111–120 and pp. 121–128.

In the processes of spray compacting it is possible to produce larger cast structures, in which case semi-finished products can be produced in dimensions close to the final contours at higher cooling rates. Here, a melt, as a rule overheated by 50–150 K above the liquidus temperature, is usually atomised by means of argon or nitrogen as is the case in powder manufacture. During flight, a substantial portion of the excess heat is taken from the drops by the atomising gas so that the drops—in accordance with their size—strike the substrate in a more or less partially liquid state and weld there to the material deposited beforehand. The process is in principle suitable for the manufacture of flat products, but in particular for the production of rotationally symmetric semi-finished products such as round bars and pipes, the substrate in these cases performing a rotational movement with lateral offset during the spraying operation. Since the metal drops strike with only very low overheating, the substrate, i.e. the material already deposited beforehand, must be at a sufficiently high temperature so that homogeneous welding still occurs. However, if the temperature is too high, a liquid layer builds up on the substrate surface, which liquid layer on the one hand solidifies slowly in a conventional manner and on the other hand is thrown away from the substrate under the effect of the centrifugal force. Since the overheating of the sprayed-on metal particles is not constant as a result of their non-uniform grain-size distribution, the so-called overspray occurs anyway even at an optimum setting of the process parameters. This is the proportion of the spray particles which either fly past the substrate from the beginning or are thrown away from the latter as a result of too low a temperature. In particular in the case of expensive materials, this leads to an uneconomic yield, and in addition the fine metal powders deposited as a result in the spray chamber are in many cases dangerous as a result of their explosiveness and toxicity. Although spray compacting, compared with conventional powder metallurgy, has the advantage that all intermediate stages between powder atomising and powder compacting are dispensed with—and thus the chances of contaminating the powder surface are reduced—an enormous surface area is however still formed as in normal powder metallurgy and, in the case of highly reactive materials or even in the event of only slight contamination of the gas atmosphere in the spraying chamber, this can lead to damage to the material despite the short reaction times.

A considerable disadvantage of spray compacting consists in the fact that, although the cooling, taking place during the flight time, down into the range of the liquidus temperature takes place relatively quickly, e.g. at several thousand Kelvin per second, the subsequent cooling rate at the substrate, where the critical range between liquidus and solidus temperature is passed, is only in the order of magnitude of a few Kelvin per second. Thus the phenomena known from conventional solidification such as segregation as well as the formation of shrinkage cavities and precipitations are possible on the one hand, but so too is a coarsening of the original cast morphology. A further disadvantage of the process consists in the fact that the heat dissipation, as in all conventional solidification processes, takes place via the layers already solidified beforehand, whereupon the heat transport is reduced with increasing thickness of the substrate, which leads to non-stationary solidification conditions. On the other hand, a great advantage of the spray compacting process is that large quantities of metal in the order of magnitude of several kilograms per second can be converted, which makes the utilisation interesting within the scope of large production processes for semi-finished products. The processing aspects of spray compacting are clearly described in a paper by W. Kahl and J. Leupp "Spray Deposition of High Performance Aluminium Alloys via the Osprey Process" in Swiss Materials 2/4 (1990), pp. 17–19.

SUMMARY OF THE INVENTION

The object of the invention, then, is to specify a process for the manufacture of metal strip by rapid solidification from the melt, in which process this strip can also be welded into thick-walled rotationally symmetric composite bodies while utilising the residual heat, and to specify an apparatus suitable for carrying out the process.

In a similar manner to the melt-spinning process, an overheated metal melt in the form of a more or less closed stream is here preferably applied to the inner surface of a rotating and essentially rotationally symmetric mould cavity, in a similar manner to centrifugal casting. Unlike melt spinning, where the heat is abstracted solely by the rotating cooling roll, the heat abstraction in the present process takes place mainly by heat transfer into a liquid cooling medium which is sprayed at a point approximately in the same plane of rotation, but offset by a certain angle of rotation relative to the location of the application of metal, onto the metal film just deposited and forms a coolant film there. As a result, both films develop on the one hand under the effect of the mechanical accelerations at the locations of their application and under the heat transfer conditions in the metal layer formed in the course of the last revolution and between the films and in particular as a function of the temperatures of the surfaces participating in the material transport as well as of the physical properties of the participating phases, such as thermal conductivity, density, solidification range, undercooling conditions, etc.

Three areas can be differentiated in the liquid cooling. At temperatures below the boiling point of the coolant, an intense cooling effect can generally be achieved, since the heat transfer takes place directly into the liquid phase with its relatively high density and heat capacity. If the temperature is increased into an area above the boiling temperature, a second area is reached where the Leydenfrost phenomenon occurs: a vapour film forms at the phase boundary due to partial vaporisation of the coolant, which vapour film prevents direct contact between the metal phase and the liquid coolant. The heat transfer can therefore fall by powers of ten. A third—and for the purposes of the present invention decisive—area is reached when the liquid cooling phase has a large temperature gradient on the one hand and a high relative velocity on the other hand relative to the hot surface to be cooled. Due to the turbulent conditions associated therewith at the phase boundary of the coolant against the surface to be cooled, no vapour film can form, which ensures the full cooling output directly into the cooling liquid. Such conditions prevail in the liquid-gas atomising process, where a melt is atomised into small powder particles by a rapidly moving stream of a low-temperature liquefied gas. Practical tests have shown that in this process coefficients of heat transfer occur which can substantially exceed those of the melt-spinning process.

The process according to the invention has in particular two important differences from the conventional melt-spinning process: on the one hand, although a portion of the heat of the freshly applied metal film is transferred into an underlying solid metal layer, this metal is the cast body formed in the course of the last revolution; on the other hand, a substantial portion of the heat is given off directly to the liquid cooling medium. The fact that both films, i.e. metal and coolant, are pressed onto the layer lying underneath in each case under the effect of the centrifugal acceleration, which leads to an improvement in the heat transfer, may be considered to be an additional, but not essential, feature of the process.

The process according to the invention is also clearly distinguished from the conventional centrifugal casting by the fact that the solidification of the melt applied during the course of a revolution takes place essentially during this revolution.

Depending on the extent of the heat portion which passes directly into the liquid cooling medium, substantial and differential effects on the shape and structure of the developing cast product result. If the fed quantity of metal is selected to be smaller in relation to the speed of revolution, as is the case, for instance, in melt spinning, strip having a thickness in the order of magnitude around 0.05 mm results at peripheral velocities, for example, in the range of 50–100 m/sec. If the coolant is now applied just after the metal film is produced and the cooling action is maintained for a longer period in the course of the further revolution, a substantial portion of the heat of the freshly applied metal layer passes into the liquid coolant, which absorbs this heat by vaporisation. Upon completion of the rotation, the coolant is completely vaporised so that the new formation of metal film can take place on a clean and low-temperature substrate surface. Since the heat quantity in the film is insufficient for welding to the last metal layer, this results in a strip coil winding up by itself. The cooling rates achieved here can be up to the order of magnitude of a hundred million Kelvin per second.

If, instead of strip, a thicker, essentially rotationally symmetric body, e.g. in the form of a ring, is to be manufactured in accordance with the process according to the invention, the mode of operation described above can be used in principle, but a lower quantity of coolant in relation to the quantity of metal is used, the quantity of metal and the rotary movement preferably being matched to one another in such a way that the metal film applied has as a rule a thickness of more than 0.2 mm. It is also of advantage in this mode of operation if the moment of applying the coolant is delayed compared with the above example. In this way, the cooling effect starts later on the one hand, so that the freshly applied film has more time for welding to the layer applied last, and on the other hand the coolant quantity, reduced compared with the quantity of metal, ensures that the cooling effect ceases suddenly after complete vaporisation of the coolant so that greater residual heat remains in the welded film, which residual heat facilitates successful welding in the course of the next film application.

The relationships during this welding therefore lead to a type of "casting laminate" and lie between the slow solidification in the spray compacting described above and the rapid solidification in special processes like plasma spraying or laser treatment. Whereas welding of the relatively cold metal drops in spray compacting is only possible with a hot substrate, in the high-energy surface treatments thin layers can also be joined to a cold primary layer, since the high local energy density leads to welding before substantial portions of the heat of the melt can dissipate into deeper areas of the substrate so as to be of no use to the welding process.

Compared with spray compacting, another substantial advantage is obtained in the process according to the invention. Whereas in spray compacting a large number of small drops having an enormous cumulative surface are formed, which drops can react with impurities in the atmosphere of the usually voluminous and complex spraying chamber over a longer period at relatively high temperatures, the specific surface of a closed film is substantially smaller, and in addition the possibility of reaction is greatly restricted on account of the short application distance and the higher cooling rate. Of great importance, however, is a further advantage: whereas in spray compacting a portion of the material is lost as so-called overspray, full application of the quantity of melt in the article produced is largely obtained in the process according to the invention.

BRIEF DESCRIPTION OF THE DRAWINGS

The process according to the invention as well as apparatuses for carrying it out are described in greater detail below with reference to figures representing exemplary embodiments. In the drawings.

DESCRIPTION OF THE PREFERRED EMBODIMENTS

Figure 1:
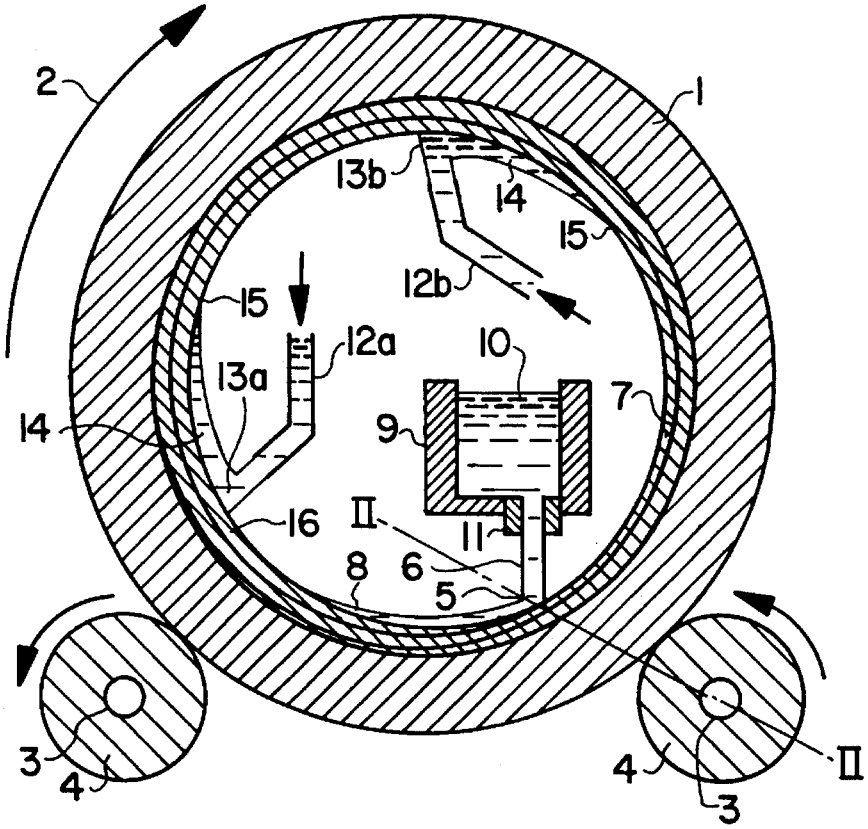
FIG. 1 shows the fundamental sequence of the process according to the invention with reference to a first embodiment, shown in cross-section, of a corresponding apparatus.
Figure 2:
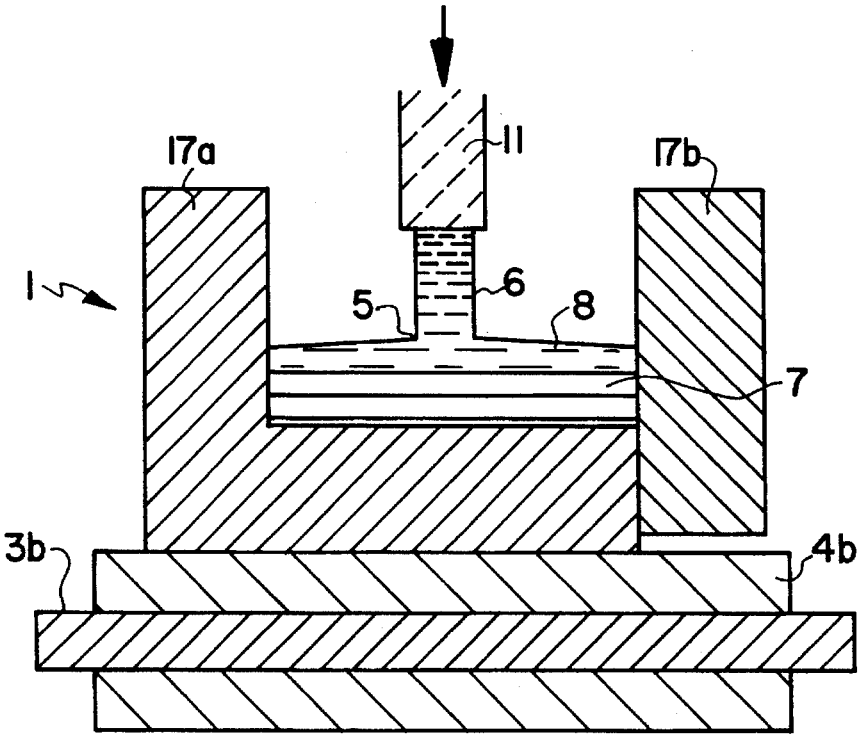
FIG. 2 shows a section along line II—II in FIG. 1, FIGS. 3*a*–3*c* show radial temperature profiles as occur in a first variant of the process according to the invention.

FIGS. 1 and 2 show in cross-section and longitudinal section respectively an embodiment of an apparatus according to the invention. Here, a cylindrical mould body 1 rotates in the direction of an arrow 2 about a rotational axis, the rotary movement being effected inside rollers 4 which are mounted on spindles 3 and of which two are represented in the drawing. At least one of these rollers must be designed as a drive roller. In the present case and also in the following drawings, the axis of rotation is arranged horizontally, but a vertical arrangement is also easily possible within the scope of the invention, since the acceleration due to gravity only has a slight effect compared with the rotational acceleration. At a pouring point 5, a stream 6 of overheated melt strikes the inner surface of the outermost metal layer 7 formed in the course of the previous revolution, a liquid metal film 8 being formed.

The stream 6 originates from the melt 10 located in a container 9, in which arrangement the container 9 can be either a melting or holding furnace or even only an unheated intermediate container for receiving the overheated melt. A discharge opening for the melt in the form of a pouring nozzle 11 can be designed in a similar way to the relationships in melt spinning with regard to both its shape and its arrangement relative to the pouring point 5 in such a way that optimum hydrodynamic conditions develop for the film formation. In effect, the pouring nozzle 11 can have a circular cross-section or even a cross-section differing from the circular shape, e.g. a rectangular cross-section. As known in the melt-spinning processes, it is also perfectly possible to connect a plurality of pouring nozzles 11 in parallel to produce wider strip or ring structures. In addition, a certain pressure can be applied to the melt 10 in the container 9 so that it comes out of the pouring nozzle 11 with a desired velocity or quantity per unit of time, it being possible at the same time for the melt to be protected from contact with the ambient atmosphere.

As shown, the stream 6, as in melt spinning, can be directed towards the pouring point 5 in an essentially closed manner or, as in spray compacting, can be dispersed in drops by a stream of a fluid, preferably gaseous, medium. In the former case, a smaller surface of the melt together with correspondingly fewer chances of reaction of the same with the surrounding atmosphere results; in the latter case a more uniform application of the melt results. In contrast to spray compacting, however, the splitting-up of the stream 6 does not serve the rapid cooling below the solidification temperature; the drops are to remain liquid.

Cooling liquid, e.g. liquid nitrogen, is applied to the metal film 8 at points 13*a*, 13*b* from cooling nozzles 12*a*, 12*b*, in the course of which they in each case form a coolant film 14 on the metal film 8, which coolant film 14 is completely vaporised at point 15. A single cooling nozzle is sufficient in many cases. As in the case of the metal melt, the coolant can also be applied from a plurality of nozzles arranged side by side if a wider metal film 8 is desired. The parts of the apparatus which are required for this in each case should be imagined as being lined up in a congruent manner in FIG. 1 behind the parts shown. They would perform functions analogous to these parts. In the present example, the metal film 8 is completely solidified at a point 16. In most cases, the point 16 is located in the direction of rotation in front of the cooling point 13 so that the liquid coolant only comes into contact with the completely solidified metal film 8.

It is apparent from FIG. 2 that the cylindrical mould body 1 has at its inner wall a groove-like recess which is laterally defined by a side wall 17*a* firmly connected to the inner wall and by a removable side wall 17*b*. In this recess, the melt 10 from the pouring nozzle 11, while forming the metal film 8, is applied in the form of a stream 6 at the pouring point 5 to the innermost metal layer 7 of the metal layers already formed in the course of the previous revolutions.

Figure 3A:
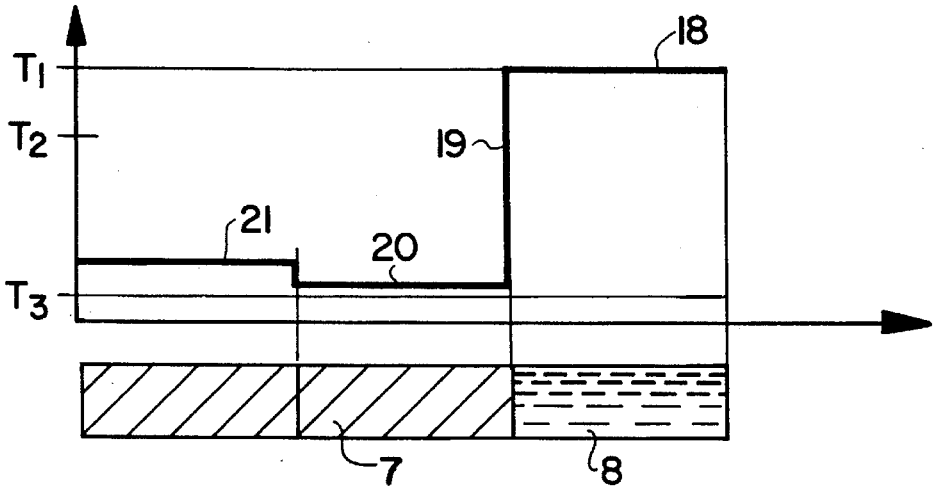
Figure 3B:
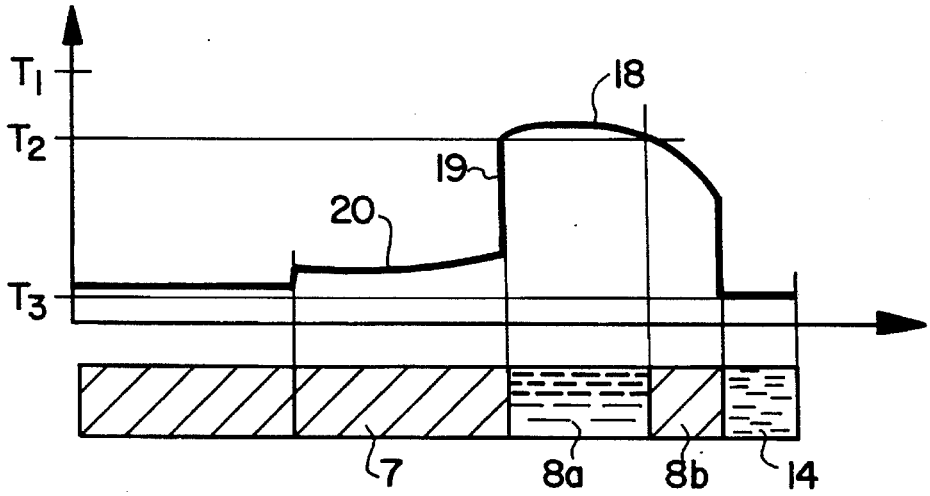
Figure 3C:
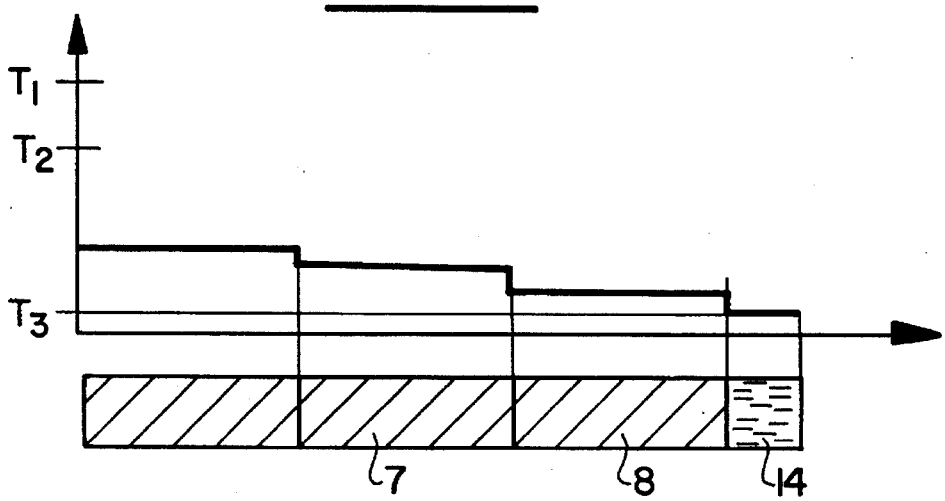

FIGS. 3*a*–3*c* show three typical phases in a first variant of the process according to the invention for the manufacture of rapidly solidifying strip in a diagram which shows the radial temperature profile over a plurality of layers.

Here, FIG. 3*a* shows the moment at which a new metal film 8 has just been applied with a melt at the overheating temperature $T_1$, which is represented by the curve section 18. The temperature drop 19 represents the heat transfer resistance to the innermost metal layer 7 which has developed and solidified in the course of the last revolution and whose temperature is represented by the curve section 20. The next lower layer—curve section 21—also shows an abrupt temperature drop to the curve section 20. In all cases this abrupt temperature drop is caused by the existence of an air gap, i.e. by the fact that—for the purposes of the strip manufacture—welding has not occurred.

FIG. 3*b* shows a rapidly following phase, just after the liquid coolant film 14 is applied at a temperature $T_3$ to the surface of the at least partly solidified metal film 8. The high temperature of the curve section 18, which high temperature results from the original overheating and is shown in FIG. 3*a*, has now dropped to a considerable extent by heat transfer to the adjoining innermost metal layer 7 and in particular by heat transfer into the coolant film 14, the metal film 8 being cooled down in a zone 8*b* below the solidification temperature $T_2$ and thus being completely solidified. The temperature of the innermost metal layer 7 has certainly increased somewhat in accordance with curve section 20 during the entire operation, but the heat in the liquid residual zone 8*a* is not sufficient to bring about welding to the adjoining innermost metal layer 7.

FIG. 3*c* shows a phase directly before the end of a revolution, just before the next overheated metal film 8 is applied according to FIG. 3*a*. In this phase, the temperature of the metal film 8 may have fallen to such an extent that the heat flow reverses, i.e. the metal layers already formed beforehand give off heat to the metal film 8 formed last. It is clear that between FIG. 3*c* and FIG. 3*a*, i.e. the start of the next cycle, at least enough time has to pass for the coolant film 14 to be completely vaporised. Since the process according to the invention, like the melt-spinning process, on the one hand gives off the heat of the overheated melt to a metal substrate but in addition transfers a substantial portion of the heat into the liquid low-temperature coolant, potentially higher cooling rates result.

Figure 4A:
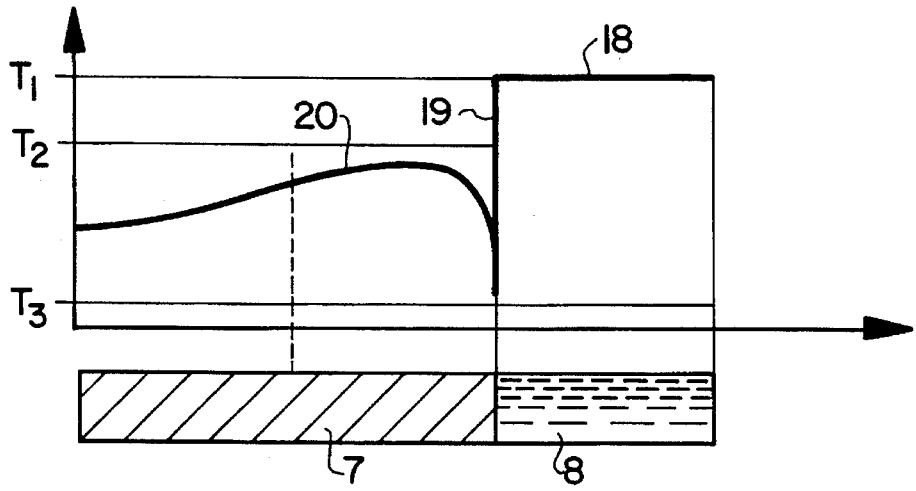
FIGS. 4*a*–4*c* show radial temperature profiles as occur in a second variant of the process according to the invention.
Figure 4B:
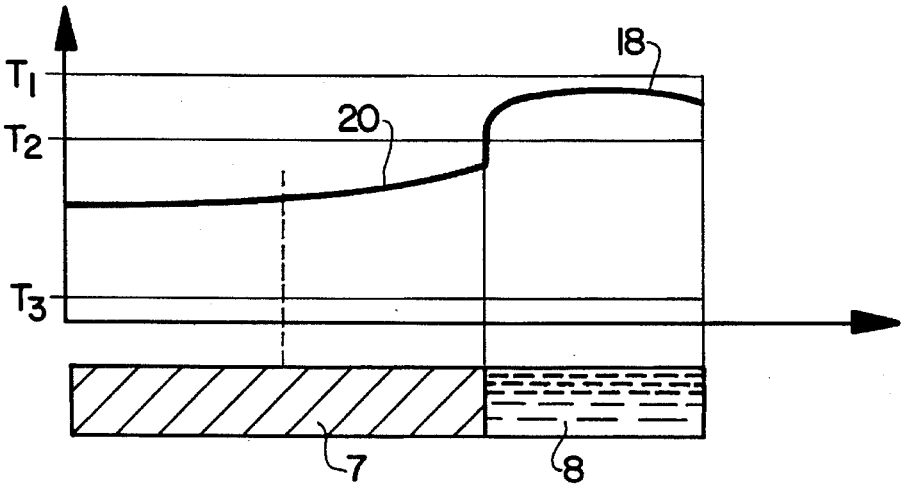
Figure 4C:
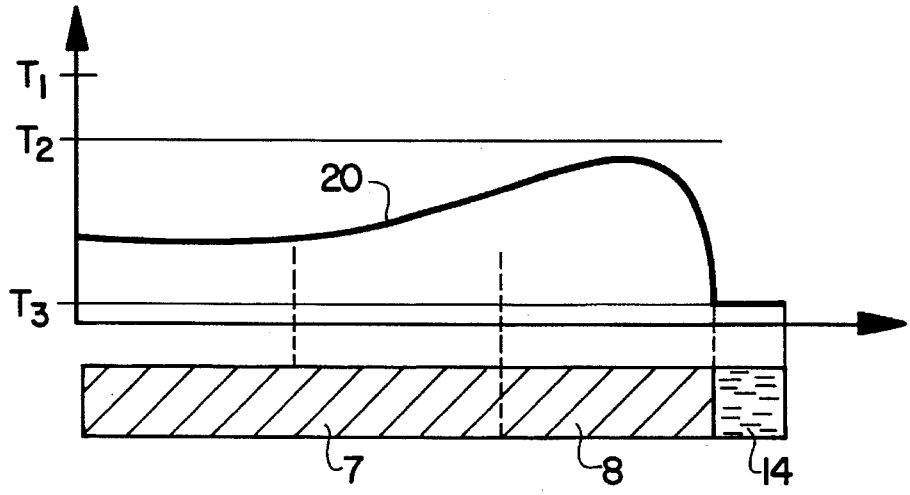

FIGS. 4*a*–4*c* show three phases in a second variant of the process according to the invention for the manufacture of a composite body welded continuously from strip and virtually in the form of a cast laminated material.

Here, in FIG. 4*a*, an overheated metal film 8 is applied at the temperature $T_1$ in accordance with the curve section 18 of the temperature curve. Since welding to the innermost metal layer 7 has not yet occurred, there is a sharp temperature drop in accordance with curve section 19 to the temperature of the previous layer in accordance with curve section 20. The profile, dropping to both sides, of the temperature curve 20 results from the fact that the heat centre of solidification during the course of the last revolution lay in this area. The heat now flows from both sides into the depression between curve sections 19 and 20 so that rapid heating-up of the surface of the innermost metal layer 7 occurs.

FIG. 4*b* shows the moment directly before the welding. The temperature of the innermost metal layer 7 solidified last now almost corresponds to the melt point; that of the liquid metal film 8 still lies above the liquidus temperature $T_2$.

FIG. 4*c* shows an instant some time after the welding, just at the start of the application of the liquid coolant film 14. A marginal area of the innermost metal layer 7 is no longer visible, which marginal area has been briefly fused again, since the same has in the meantime solidified just like the newly applied metal film 8. As a result of the welding, the solidified marginal zone 8 finally merges without transition into the innermost metal layer 7, which manifests itself in the continuous profile of the branch 20 of the temperature curve.

Figure 5:
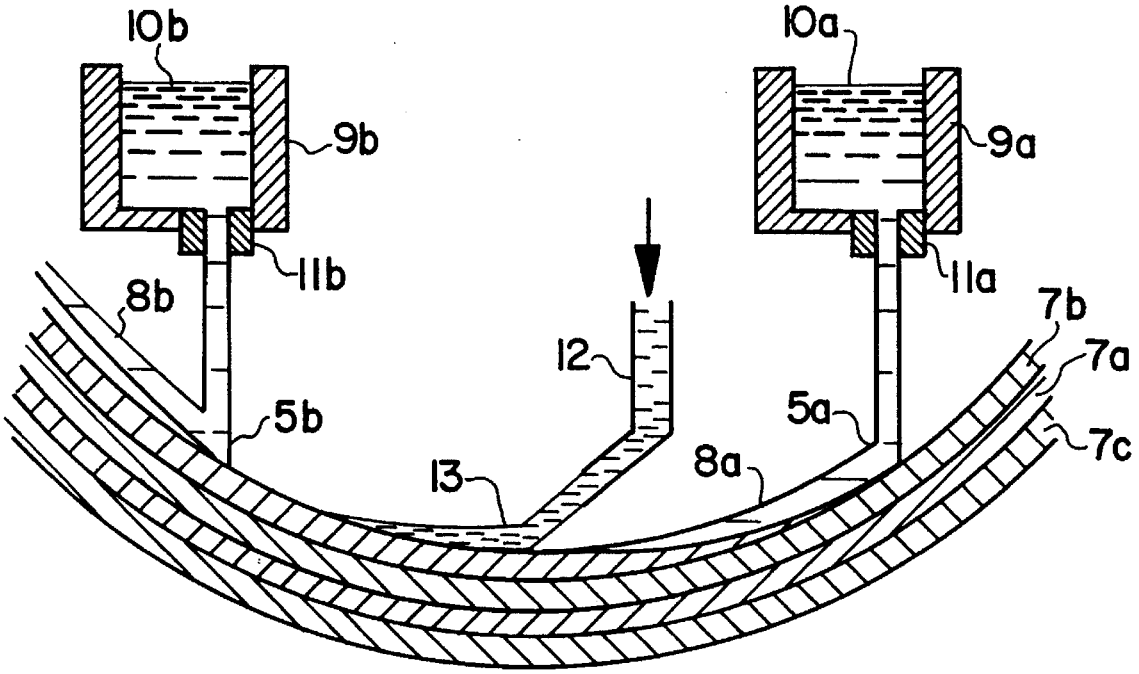
FIG. 5 shows a cross-section of a second embodiment of an apparatus for carrying out the process according to the invention.

FIG. 5 shows an embodiment of an apparatus according to the invention which has devices for applying two melts 10*a* and 10*b* in series in the course of a revolution as metal films 8*a* and 8*b*, which, as explained in connection with FIGS. 4*a*–4*c*, are subsequently welded to one another, which is brought about by appropriate metering of the coolant at the cooling point 13. The application (not shown) of a further coolant film having a more intensive cooling action takes place behind the pouring point 5*b*. On account of this intensive cooling action, only the two metal layers 7*a* and 7*b* are welded, but not to the metal layer 7*c* underneath. If the composition of the two metal layers 7*a* and 7*b* is identical, thicker strip is produced in this way at a higher cooling rate. If the composition of these layers is different, bimetal strip is obtained. More than two liquid metal films can of course be applied in sequence so that, instead of bimetal strip, strip of more complex structure develops.

Figure 6:
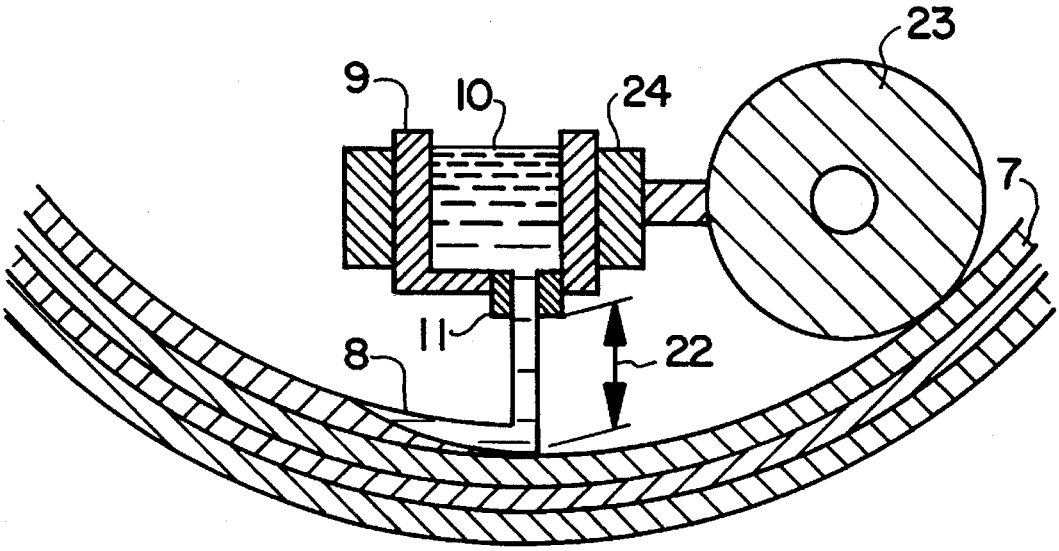
FIG. 6 shows a cross-section of a third embodiment of an apparatus for carrying out the process according to the invention.

FIG. 6 shows an embodiment of an apparatus according to the invention which is specifically suitable for the manufacture of thin, rapidly solidified strip. By analogy with the melt-spinning process, the distance 22 between the pouring point 5 and the discharge opening of the pouring nozzle 11 is here to be kept as constant as possible. Since, in contrast to the melt-spinning process, the innermost metal layer 7 produced in the course of the last revolution is used as a substrate, continuous displacement of the pouring point 5 occurs relative to the original surface of the mould body 1. In the present example, the constant distance 22 is maintained by a distance roller 23 rolling on the innermost metal layer 7 formed last, which distance roller 23, via a holding device 24, displaces the container 9 having the metal melt 10 so that the pouring nozzle 11 follows the movement of the coil build-up. Unlike this mechanical control, it is of course also conceivable to establish the distance between the pouring nozzle 11 and the pouring point 5 via an electronic measuring probe, in the course of which a control circuit ensures that the position of the pouring nozzle 11 is readjusted, for instance, via an electromechanical actuator.

Figure 7:
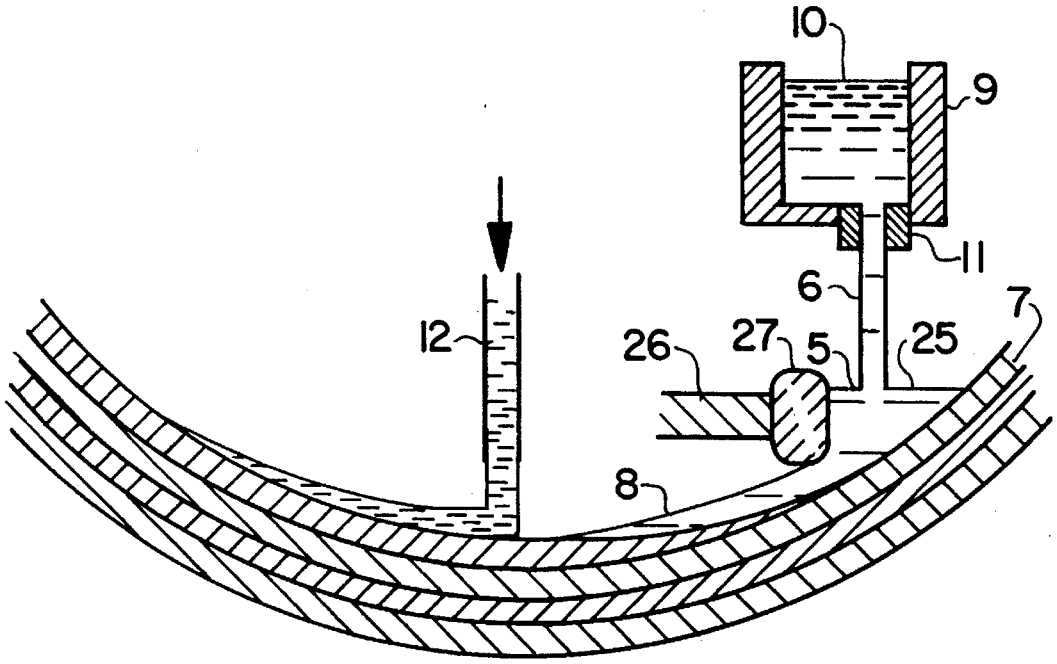
FIG. 7 shows a cross-section of a fourth embodiment of an apparatus for carrying out the process according to the invention.

FIG. 7 shows an embodiment of an apparatus according to the invention which is specifically suitable for the manufacture of thicker strip or of sheet, in particular when greater width is desired. Whereas the geometry in very thin strip is determined by the inherent dynamics of the metal film, i.e. its thermal and rheological properties as well as the acceleration forces upon striking the surface, so that the width and thickness of the strip are predetermined as a function of material constants of surface and melt, their temperatures and the relative velocities, this is less the case in thicker strip or sheet. In order to obtain a uniform distribution here over the entire width of the pouring zone, the pouring point 5 is formed as a metal bath 25, the volume of this metal bath on the one hand being limited in three spatial directions by the side walls 17*a*, 17*b* of the rotating cylindrical mould body 1 (FIG. 2) and the inner surface of the solidified innermost metal layer 7 produced in the course of the last revolution, while a retaining wall 27 fixed by means of a holding device 26 and made of a material resistant to melting forms the limit in the direction of rotation, this retaining wall 27 on the one hand forming a minimum gap laterally relative to the walls 17*a*, 17*b* of the rotating mould body 1, which minimum gap essentially prevents metal melt from flowing out of the bath 25, and on the other hand forming a pouring gap of a certain width at the bottom with the inner surface of the innermost metal layer 7, which pouring gap determines the thickness of the liquid metal film 8. In the interest of the constant width of this pouring gap, the measures proposed according to FIG. 6 can be used, i.e. the holding device 26 of the retaining wall 27 can be kept at a constant distance from the respective inner surface either by a distance roller 23 (FIG. 6) or by electronic means.

Figure 8:
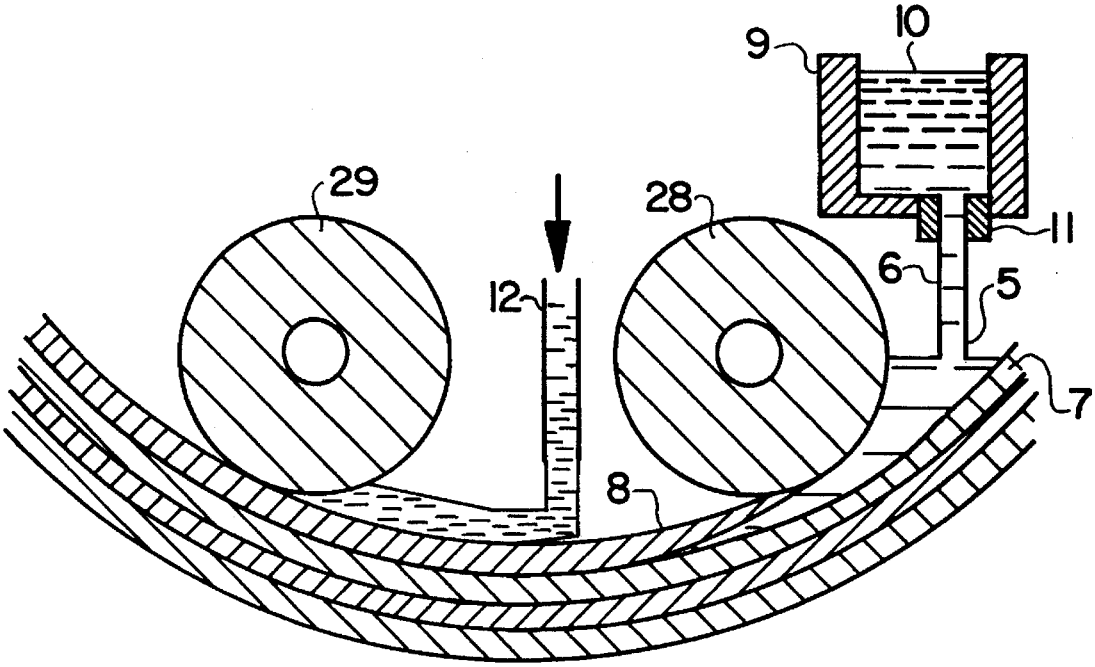
FIG. 8 shows a cross-section of a fifth embodiment of an apparatus for carrying out the process according to the invention.

FIG. 8 shows a further embodiment of an apparatus according to the invention having a similar objective to that according to FIG. 7. In this arrangement, the stream 6 of metal melt is likewise fed into a bath 25, but in this case the lateral limit in the direction of rotation is formed by a retaining roll 28, which, in the same way as the retaining wall 27 described in FIG. 7, forms a pouring gap with the innermost metal layer 7 formed during the previous revolution. At the cooling point 13, the cooling liquid is fed via a cooling nozzle 12, the cooling liquid being distributed by a roll 29 in a similar manner to the metal melt in the present example. An arrangement (not shown in FIG. 7) is also conceivable in which the cooling liquid is fed in the direction of rotation behind the roll 29. In such a case, the roll 29 on the one hand serves to roll the partially or fully solidified metal film 8 into the plane and in addition prevents liquid or gaseous coolant from flooding back into the area of the still liquid metal film 8.

Figure 9:
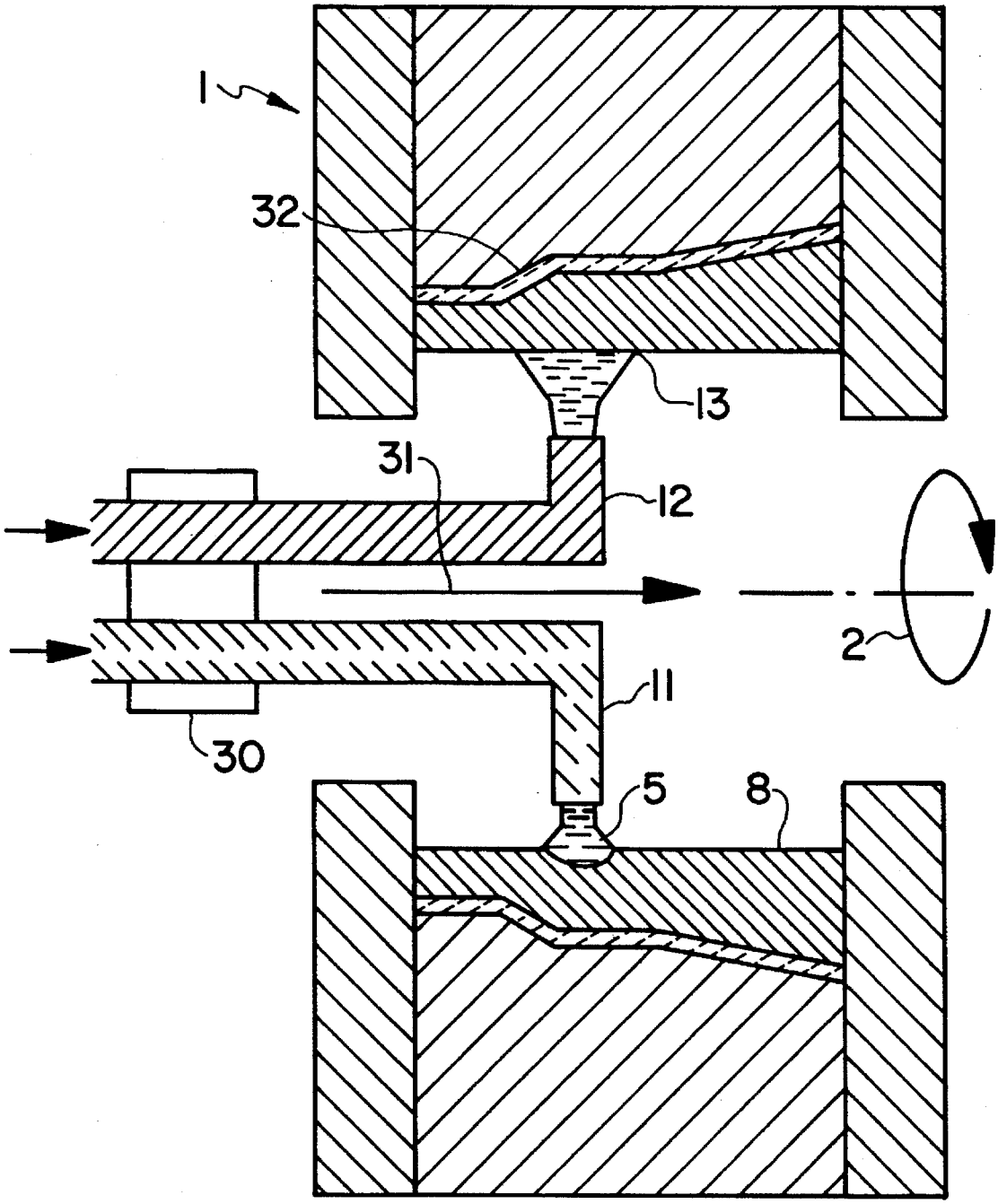
FIG. 9 shows a longitudinal section of a sixth embodiment of an apparatus for carrying out the process according to the invention.

FIG. 9 shows a further embodiment of an apparatus for carrying out the process according to the invention, which apparatus specifically serves to manufacture parts which have a complex shape and are essentially rotationally symmetric. For this purpose, the pouring nozzle 11 and the cooling nozzle 12 are fastened to a common holding device 30 and can be moved in the interior of the rotating mould body 1 in the direction of an arrow 31. In the present example, for the sake of clarity of the representation, the cooling point 13 is displaced in the direction of rotation by half a turn relative to the pouring point 5. Other displacement angles are of course also possible; it need only be ensured that the time interval before the application of the coolant is sufficient to guarantee sufficient preliminary solidification of the metal film 8, so that impairment through the possibly violent cooling reaction is avoided, and so that the time interval after application of the coolant is sufficiently large for the coolant to be vaporised before application of the next metal film.

In the present example, the mould body 1, apart from two end side walls 17*a*, 17*b*, has a shaping inner wall 32 which has to be made of a material which can thermally and mechanically resist the attack of the melt. Since the heat dissipation takes place in substantial portions to the inside via the vaporising coolant, the inner wall 32, at least in an area adjacent to the surface, can be made of a ceramic material having a low thermal conductivity. In such a case, the rotating mould body 1 then consists, for instance, of an outer wall, which is made of a material, e.g. metal, which can absorb the mechanical forces occurring during the rotational operation, as well as of an inner part which can bear thermal loads. In this arrangement, the inner part can be a disposable part which is replaced after every casting operation. This has the advantage that geometrical shapes having undercuts without a parting line can also be cast, since the ceramic mould material can be removed from the mould body 1 after the casting operation together with the essentially cylindrically symmetric casting.

An essentially rotationally symmetric composite body is then built up in this way: the metal melt applied at the pouring point 5 forms a film 8 which in the course of the further rotation welds to the already deposited metal and at least partly solidifies. After a certain angle of rotation, the liquid coolant, e.g. liquid nitrogen, is applied, the quantity being selected in such a way that residual heat remains in the newly applied metal film 8 after complete vaporisation of the coolant, which residual heat permits welding to newly deposited material in the course of the following revolutions. The holding device 30 can be moved at a certain feed rate along the rotational axis in the direction of arrow 31, but a reciprocating movement matched to the quantity of the deposited metal is also possible, during which the inner surface of the composite body is built up in a controlled manner. In the simplest case, such an apparatus can serve to build up a pipe. In both this case and all examples described, it is easily possible to apply other materials, e.g. ceramic or metallic phases in the form of powders or fibres or the like, before, during or after the formation of the liquid metal film from an apparatus (not shown), e.g. with the use of a pneumatic conveying means, to the rotating inner surface of the developing composite body so that a composite material results.

Figure 10A:
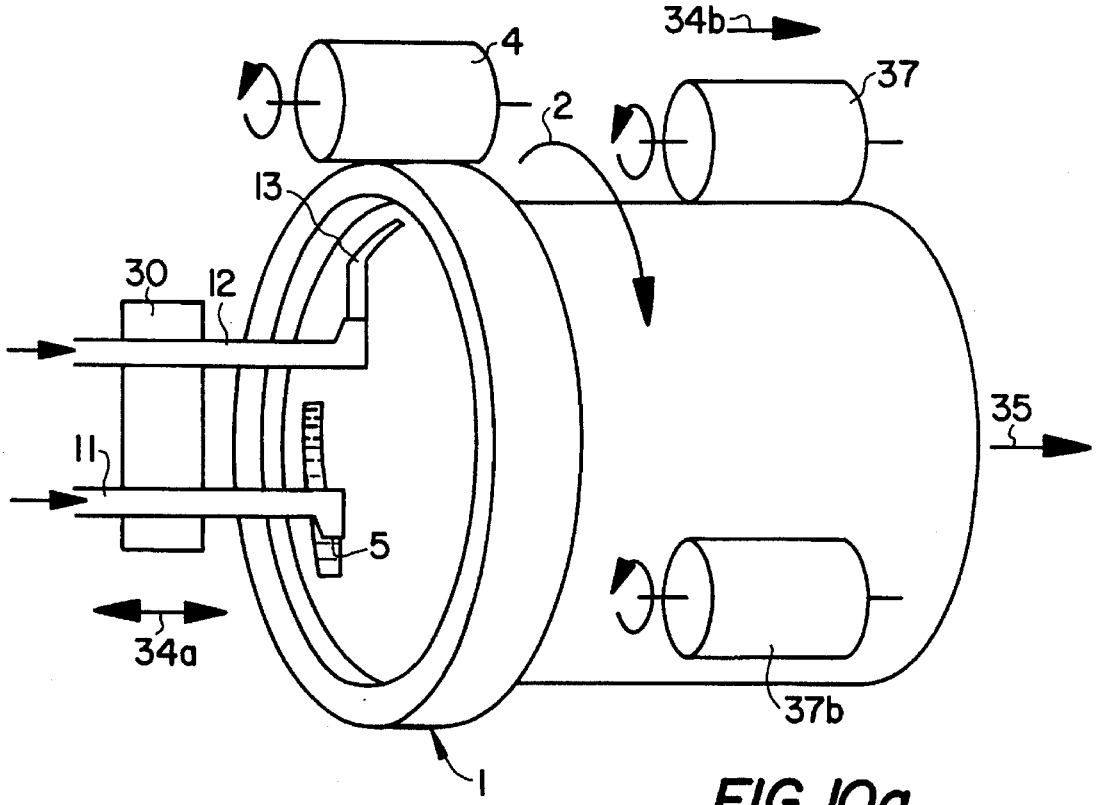
FIG. 10*a* shows a perspective representation of a first specific embodiment of the process according to the invention with reference to a corresponding apparatus.
Figure 10B:
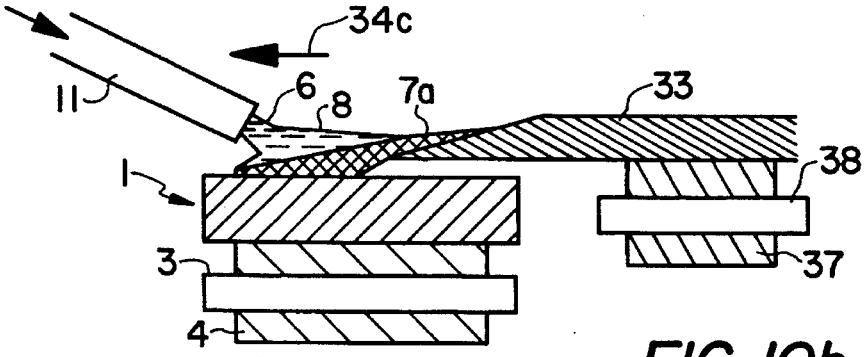
FIGS. 10*b*, 10*c* show two phases of the embodiment of the process according to FIG. 10*a* in detail in longitudinal sections.
Figure 10C:
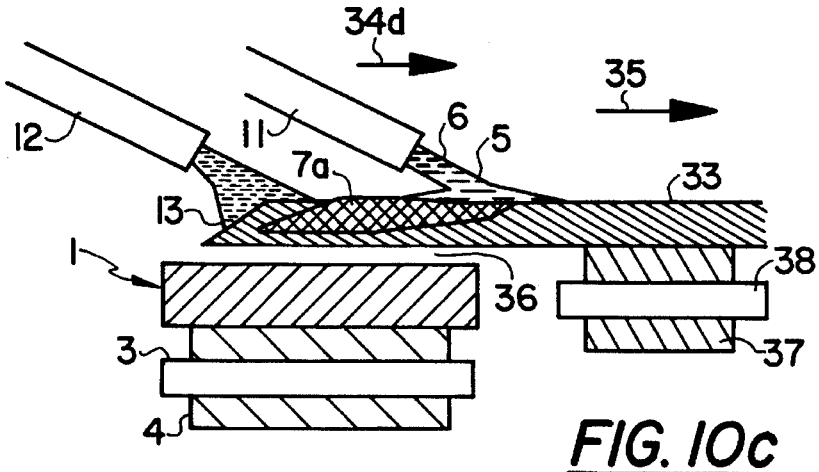

FIG. 10*a* shows an embodiment of an apparatus according to the invention for manufacturing an endless pipe, FIGS. 10*b* and 10*c* demonstrating in a schematic manner two characteristic situations from the sequence of the manufacturing process. In this arrangement, the pouring nozzle 11 and the cooling nozzle 12 are fastened as in FIG. 9 to a common holding device 30, the pouring point 5 and the cooling point 13 being offset from one another by a certain angle of rotation. Here, the said points need not necessarily be arranged in the same plane of rotation but can be displaced relative to one another in the direction of the rotational axis. The holding device 30 together with the pouring nozzle 11 and the cooling nozzle 12 performs an oscillating movement relative to the rotating mould body 1 in the axial direction in accordance with double arrow 34*a*. The pipe 33 is drawn off in the direction of arrow 35.

FIG. 10*b* shows the build-up moment of a new outer layer of the endless pipe, this moment, in the present representation, approximately corresponding to the left-hand end point of the oscillating movement of the holding device 30 in the direction of arrow 34*c*. The melt passes from the pouring nozzle 11 in the form of a stream 6 onto the inner surface of the rotating mould body 1, in the course of which a liquid metal film 8 is formed which, in direct contact with the cylindrical mould body 1 cooled from outside, forms a firm marginal layer 7*a*, of which at least a substantial part is solidified so that it has adequate mechanical strength. This largely solidified zone 7*a* merges into the adjoining completely solidified part of the pipe 33.

FIG. 10*c* shows a moment after the actions in FIG. 10*b*. Here, the holding device 30 has performed a movement to the right in accordance with arrow 34*d* and is located just in front of the reversal point. At the same time, the pipe 33 has performed a rotary movement as indicated in FIG. 10*a*.

The pouring point 5 is accordingly located further to the right inside the rotating mould body 1, and likewise the cooling point 13 has moved to the right, the cooling nozzle 12, for the sake of simplicity of the representation, having been placed like the pouring nozzle 11 in the plane of the drawing, although it is actually offset by a certain angle of rotation in the direction of rotation. The action of the coolant leads to pronounced cooling of the initial zone of the pipe 33 so that the solidification now largely includes the entire pipe cross-section built up in the course of the actions according to FIG. 10*b*. At the same time, the pipe 33 is built up by means of the pouring nozzle 11, displaced to the right, for the application of the melt until the final inside diameter of the pipe 33 is reached. The substantial solidification of the pipe 33 on account of the heat abstraction from inside by the coolant leads to a contraction in the outside diameter of the pipe 33, as a result of which a casting gap 36 is formed relative to the rotating mould body 1. This action takes place between the moments according to FIGS. 10*b* and 10*c*, that is, in the course of the movement of the holding device 30 in the direction of arrow 34*d*.

As soon as contact is lost between the freshly formed outer circumferential surface of the pipe 33 and the rotating mould body 1, the rotary movement of the pipe is only supported by a plurality of withdrawal rollers 37 mounted on spindles 38. The withdrawal rollers 37 are movable in the direction of the rotational axis and, the moment contact is lost between the pipe 33 and the rotating mould body 1, perform a short movement in the direction of arrow 34*b*, in the course of which the pipe 33 is withdrawn from the cylindrical mould body 1 by a distance which is in the order of magnitude of the amplitude of oscillation. As soon as a new metal film 8 has been built up on the end face of the pipe in accordance with FIG. 10*b*, the withdrawal rollers 37 can be briefly lifted from the pipe 33 and displaced by the same amount to the left, where they are then brought into contact with the pipe 33 again. As is the case in conventional continuous casting, desired lengths of pipe have to be cut off from the endless pipe at certain time intervals by a cutting device (not shown).

Figure 11A:
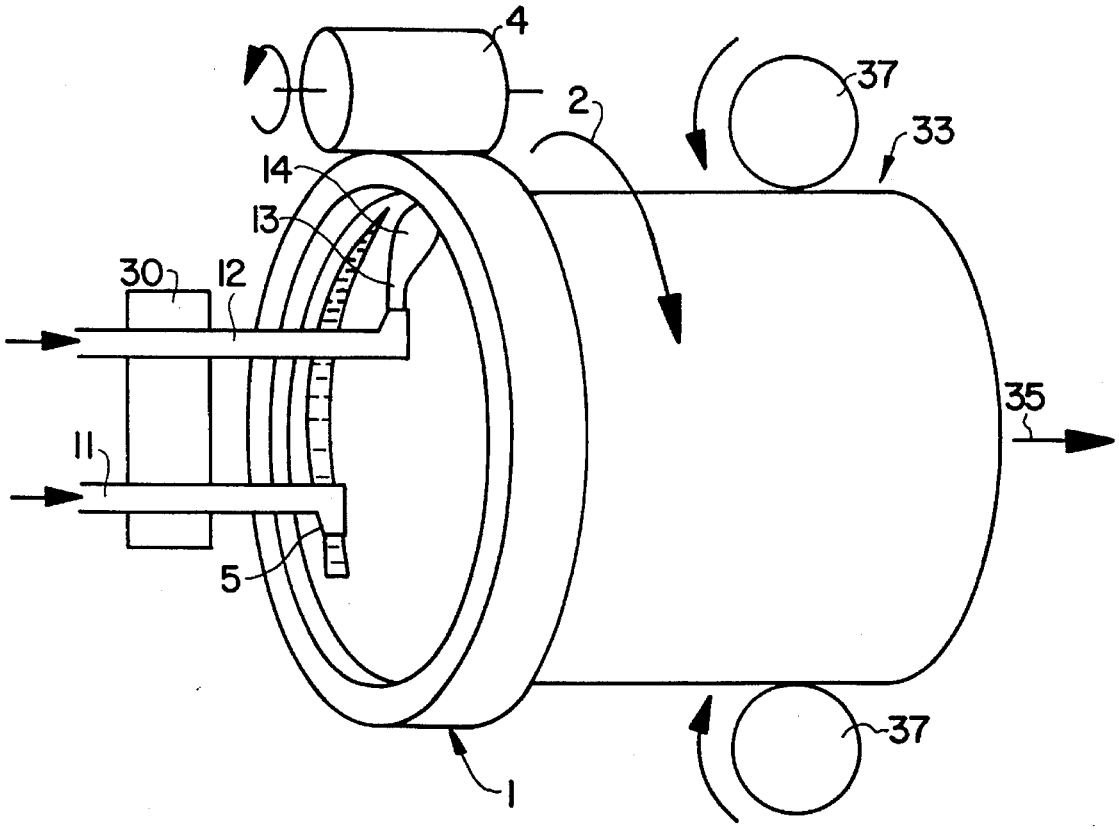
FIG. 11*a* shows a perspective representation of a second specific embodiment of the process according to the invention with reference to a corresponding apparatus.

FIG. 11*a* shows a further embodiment of an apparatus according to the invention which is suitable for producing an endless pipe. Whereas the pipe 33 in the last example assumed the rotational speed of the rotating mould body 1, here a case is shown where only the actual zone of build-up follows the rotational movement, while the solidified pipe 33 performs no rotary movement. As in the apparatus according to FIG. 10*a*, the pouring nozzle 11 and the cooling nozzle 12 are arranged so as to be movable in the direction of the rotational axis of the mould body 1 by means of a common holding device 30, in which arrangement the cooling point 13 is offset by a certain angle in the direction of rotation and can also be displaced by a certain amount relative to the pouring point 5 in the draw-off direction in accordance with arrow 35. Whereas the roller 4 is representative of all rollers which keep the rotating mould body 1 moving, the two withdrawal rollers 37 are representative of a larger number of withdrawal rollers which move the pipe 33 out of the rotating mould body 1.

Figure 11B:
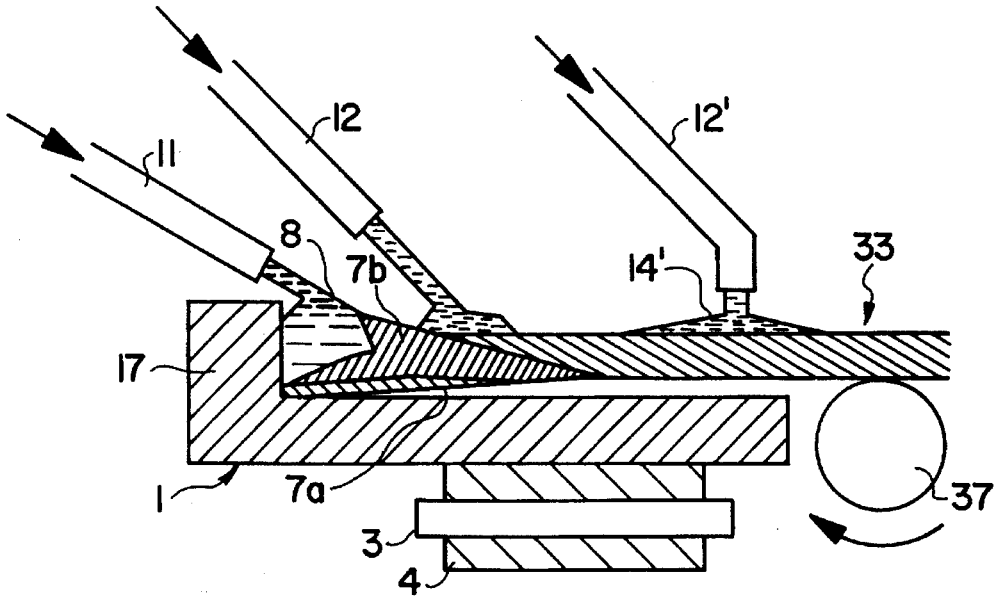
FIG. 11*b* shows the embodiment of the process according to FIG. 11*a* in detail in a longitudinal section.

FIG. 11*b*, in a schematic section, shows the principle of the action shown in FIG. 11*a*. The rotating mould body 1 has a side wall 17 which is preferably made of a heat-insulating material and which prevents the melt, which forms a liquid metal film 8, from flowing off to the left. Since the rotating mould body 1, which is preferably made of a metallic ingot material, is cooled from the outside, a partially solidified zone 7*a* forms; but cross-linking of the dendrites has still not occurred at this partially solidified zone 7*a*, so that it still has the properties of a thixotropic liquid. At the same time, a cooling liquid is applied from a cooling nozzle 12' to the inner surface of the largely solidified pipe 33, in which arrangement the location of the formation of the coolant film 14' has to be imagined as being in the direction of rotation behind the drawing plane in which the pouring nozzle 11 lies. In the present case, the draw-off movement of the pipe 33 can take place continuously, since a partially solidified zone 7*b* forms under the pronounced cooling action of the liquid coolant, which zone 7*b*, however, as a result of its higher degree of solidification and the cross-linking of the dendrites which is effected by this, adheres to the solidified pipe 33 and therefore does not follow the rotary movement of zone 7*a*, which is driven along together with the liquid metal film 8 by the rotational movement of the mould body 1. In addition, the transition between the partially solidified zones 7*a* and 7*b* should not be imagined as a sharp transition as shown in FIG. 11*b* for the sake of simplicity but rather as a gradual transition from a partially liquid and still easily deformable zone into a partially firm and essentially rigid zone.

If the coolant in question was a liquid coolant in all previous embodiments, this generally meant a liquefied low-temperature gas, e.g. liquid nitrogen or liquid argon, for in most cases the coolant also has the additional task of protecting the freshly formed surface of the metal film 8 from contact with air. However, if the materials concerned can be atomised with water, e.g. certain non-ferrous metals, due to the fact that they do not oxidise readily, e.g. within the scope of powder metallurgy, water can also be used in the process according to the invention. The use of a reactive atmosphere which leads to the formation of metallic compounds may be suitable where a composite body is to be manufactured in which, for example, ceramic intermediate layers are embedded between the metallic layers. The ceramic intermediate layers then correspond to the previous surfaces of the liquid metal film 8 which could react with oxygen to partly form an oxide coating before a further layer is applied.

Finally, the process according to the invention is to be described with reference to two actual examples, one case concerning the manufacture of steel strip and the other the manufacture of an annular composite body of steel. In both cases, an apparatus was used which in principle corresponded to that shown in FIGS. 1 and 2. The rotating mould body 1 was a steel cylinder of 600 mm inside diameter, the width of the casting groove 5 defined laterally by the side walls 17*a*, 17*b* being 5 mm. In both cases, a stainless chrome-nickel steel was used as a test melt. Since, as a result of the unfavourable surface/volume ratio, it is difficult in the small-scale test to meter a steel melt via a stopper rod device or a miniaturised sliding shutter in a similar manner to an industrial-scale operation, a specific solution was found for the small-scale test. Known in precision casting technology are so-called rocking-type furnaces with which steel can be melted under protective gas in pure form and can be directly poured—without contact with the outer atmosphere and without the need for a pouring ladle—into hot precision moulds. The rocking-type furnace consisted of a melt container, rotatable about a horizontal axis and in the form of a cylindrical barrel of high-temperature magnesite, which contained two graphite electrodes, displaceable relative to one another, in the two lateral end faces in the axis of rotation for forming an arc. The steel alloy in the form of 15 mm bar material was introduced via an opening in the barrel, which was directed upwards during the melting operation. The furnace is rocked to and fro during the melting operation so that the walls in contact with the melt can get rid of their excess heat. The furnace charging opening, directed to the top, normally serves at the moment of casting also to fix the pouring gate of the ceramic mould, which is directed upwards and preheated. In the present case, instead of a preheated mould, a preheated pouring gate having an attached nozzle tube of zirconium oxide with an inside diameter of 5 mm was attached. The entire rocking-type furnace was mounted in the interior of the rotating mould body 1, in which arrangement the plane of rotation of the rocking-type furnace was identical to the plane of rotation of the mould body 1, and the pouring nozzle 11 of the furnace, during rotation of the same through 180°, swung exactly into the centre of the casting groove, equidistant from the side walls 17*a* and 17*b*.

After the melt in the furnace had been brought to a temperature of 1550° C., the cylindrical mould body 1 was run up to a speed of 1200 rev/min. The cooling nozzle 12, offset by 100° relative to the pouring point 5, was at this moment still swung out of the casting apparatus and was fed with liquid nitrogen a few seconds before the start of the actual experiment until the stream, initially consisting of gas and liquid, only came out in liquid form, this taking place at a rate of 380 g/sec. The rocking-type furnace was then turned upside down, whereupon the casting operation started, and directly after that—about 0.5 sec later, the cooling nozzle 12 was swung into the plane of rotation of the mould body 1 so that the cooling liquid passed into the casting groove. Within the next 7 seconds during this experiment 1050 g of steel resulted in the form of strip of 0.09 mm thickness and 5 mm width, and 140 superimposed layers were obtained in accordance with the height of the coil of about 14 mm. In the same time, a consumption of about 4 l of liquid nitrogen resulted. An immediate measurement of the metal coil revealed a temperature below 250° C.

In a second experiment, an annular composite body of stainless steel was manufactured with the same device. However, the base surface of the casting groove was coated beforehand with calcium zirconate by means of a plasma spraying operation in order to prevent undesirable heat dissipation via the mould body 1, which heat dissipation hinders a rapid appearance of a stationary welding state during a short-time test. In this case, the melt was overheated in the rocking-type furnace to 1800° C. and the mould body 1 was run up to a speed of 772 rev/min. The cooling point 13, to which liquid nitrogen was applied as coolant, was offset by a three-quarter turn of the wheel relative to the pouring point 5. In the same manner as before, the rocking-type furnace was turned on its head within the limits of a lead time, i.e. after a steady flow of the cooling liquid had appeared, and fractions of a second after that the cooling nozzle 12 was also swung in. The operation was maintained for 9 seconds, in the course of which a ring having a width of 4.5 mm, an inside diameter of 530 mm and an outside diameter of slightly less than 600 mm was obtained. The optical measurement of the temperature of the ring surface directly after completion of the test revealed a surface temperature of 1200° C. The ring was quickly brought to lower temperatures by the cooling started again immediately afterwards.

What is claimed is:

1. A process for manufacturing a metal film, comprising the steps of:

(a) directing at least one stream of overheated metal melt in a direction towards an inner surface of a mould body while rotating the mould body about an axis which is transverse to said stream direction, so that said stream impinges on said surface and forms thereon a metal film which is liquid while being formed;

(b) applying a liquid coolant onto said metal film via at least one nozzle, and thereby causing cooling of the metal film to within a solidification temperature range as said coolant evaporates.

2. The process of claim 1, further comprising:

between steps (a) and (b) permitting such cooling of an increment of the metal film that some solidification thereof occurs on said mould body prior to conducting of step (b) in regard to that increment.

3. The process of claim 1, wherein:

said at least one stream is a convergent, compact stream where said stream impinges on said surface of said mould body.

4. The process of claim 1, wherein step (a) further comprises:

acting on said stream using a fluid medium before said stream impinges on said surface of said mould body, for dispersing said stream into droplets so that said stream impinges on said surface of said mould body as droplets.

5. The process of claim 1, wherein:

said surface of said mould body is concave about said axis; and while conducting steps (a) and (b), the mould body is rotated through a plurality of revolutions about said axis, such that said metal film is built-up in a succession of solidified metal layers.

6. The process of claim 5, wherein:

step (b) includes so adjusting application of said liquid coolant that each succeeding layer of said metal film is formed without melting the respective previously formed layer of said metal film.

7. The process of claim 5, wherein:

step (b) includes so adjusting application of said liquid coolant that at least one succeeding said layer of said metal film as formed causes melting of the respective previously formed layer of said metal film.

8. The process of claim 7, further including:

displacing said film along said axis while conducting step (b), so that respective succeeding layers are helically displaced relative to respective previously formed layers along said axis.

9. Apparatus for manufacturing a metal film, comprising:

at least one container for receiving a metal melt, each said container having at least one pouring nozzle for pouring overheated metal melt from the respective said container in a stream along a direction;

a hollow mould body having an inner concave wall surface; the hollow mould body being supported for rotation in a direction about an axis about which said wall surface is concave;

each said pouring nozzle being arranged to cause said stream to impinge on said wall surface and form an initially liquid coalescent metal which can solidify upon cooling to form said metal film; and at least one coolant container, each having at least one coolant nozzle, each coolant nozzle being aimed in relation to said wall surface so as to apply coolant thereto at a site which is rotationally offset around said axis so as to trail in said direction relative to where said stream impinges on said wall surface.

10. The apparatus of claim 9, wherein:

said axis is substantially horizontal.

11. The apparatus of claim 10, wherein:

said at least one pouring nozzle comprises a plurality of pouring nozzles arranged in at least one first line extending in a direction parallel to said axis; and said at least one coolant nozzle comprises a plurality of coolant nozzles arranged in at least one second line extending in a direction parallel to said axis.

12. The apparatus of claim 9, wherein:

each said pouring nozzle is mounted by mounting means for adjustment towards and away from said wall surface generally transversely of said axis.

13. The apparatus of claim 12, wherein:

said mounting means includes a distance roller engageable with said mould body for maintaining each said pouring nozzle a selected distance from said wall surface.

14. The apparatus of claim 12, wherein said mounting means further includes:

a retaining element extending in a direction parallel to said axis and cooperatively forming with said wall surface a bath which includes a site where said stream impinges on said wall surface, wherein each said pouring nozzles pours metal melt into said bath for spreading between said retaining element and said wall surface, onto said wall surface through a slot defined between said retaining element and said wall surface;

said mounting means being adjustable transversely of said axis for varying the thickness of said slot.

15. The apparatus of claim 14, wherein:

said retaining element is a non-rotational wall.

16. The apparatus of claim 14, wherein:

said retaining element is a roller mounted for rotation about an axis which is parallel to said axis about which said mould body is rotated.

17. The apparatus of claim 9, further comprising:

means for progressively displacing said metal film along said axis as said mould body is rotated about said axis during formation of said metal film, whereby said metal film is formed as a multiple-layer helically wound tube.

18. The apparatus of claim 9, further comprising:

a common holder holding each said pouring nozzle and each said coolant nozzle; and means for oscillating said common holder in a direction which is parallel to said axis, in synchronization with rotation of said mould body and said axis.

* * * * *